US007551741B2

(12) United States Patent
Zhu

(10) Patent No.: US 7,551,741 B2
(45) Date of Patent: Jun. 23, 2009

(54) SYSTEM AND METHOD FOR 3D SOUND PROCESSING

(75) Inventor: Qinglin Zhu, Santa Clara, CA (US)

(73) Assignee: ESS Technology, Inc., Fremont, CA (US)

( * ) Notice: Subject to any disclaimer, the term of this patent is extended or adjusted under 35 U.S.C. 154(b) by 1004 days.

(21) Appl. No.: 10/851,848

(22) Filed: May 21, 2004

(65) Prior Publication Data

US 2005/0259827 A1 Nov. 24, 2005

(51) Int. Cl.
*H04R 5/00* (2006.01)

(52) U.S. Cl. ..... 381/1; 381/17; 381/18; 381/19

(58) Field of Classification Search ..... 381/1, 381/17, 18, 19, 307, 309, 310, 61, 26, 74
See application file for complete search history.

(56) References Cited

U.S. PATENT DOCUMENTS 4,121,059 A * 10/1978 Nakabayashi ..... 369/88
4,980,914 A * 12/1990 Kunugi et al. ..... 381/1
6,804,358 B1 * 10/2004 Kawano ..... 381/17
2001/0012367 A1 * 8/2001 Sotome et al. ..... 381/1

* cited by examiner

*Primary Examiner*—Vivian Chin
*Assistant Examiner*—Douglas J Suthers
(74) *Attorney, Agent, or Firm*—Farjami & Farjami LLP

(57) ABSTRACT

A system for 3D sound processing. The system includes a first processing section including a first left lattice filter and a first right lattice filter, respectively electrically connected to a second left lattice filter and a second right lattice filter, and including two negative couplers, each electrically connected to the first left and right lattice filters and also electrically connected to the second left and right lattice filters, and a second processing section including a left filter and a right filter, respectively electrically connected to the second left lattice filter and the second right lattice filter.

31 Claims, 10 Drawing Sheets

300

310
L-Input
R-Input
350
600
Second Filter
314
G2
314
G2
Second Filter
600
312
352
800
Second Enhancer
800
Second Enhancer
318
Gen1
318
Gen1
316
320
356
354
Gen2
324
Gen2
324
322
358
326
360
328
362
L-Output
330
R-Output
364

SYSTEM AND METHOD FOR 3D SOUND PROCESSING

TECHNICAL FIELD

The present disclosure relates to a system and method for 3D sound processing. More specifically, the present disclosure relates to a system and method for processing multi-channel audio for reproduction through two or more physical speakers, virtualized by the processing.

BACKGROUND OF THE INVENTION

Audio recordings may be recorded in a multi-channel format having two or more audio channels, each of which may be tailored to a specific position relative to the listener. One such format is "5.1 channel", which has five channels of full-bandwidth audio, i.e. front left (Lf), center (Center), front right (Rf), rear left (Lr), rear right (Rr), plus a sixth, narrow-bandwidth, low-frequency effect channel (Lfe). Reproducing audio media recorded in such a format typically requires one speaker and amplifier for each channel; therefore, the "5.1 channel" format described above would require six separate speakers and amplifiers.

This multiple speaker, multiple amplifier realization is costly. Also, even when fully implemented, the discrete manner in which audio sound channels in a 3-dimensional audio environment are recorded makes it difficult to provide smooth, continuous and rich 3D audio sounding like what one may experience in an actual scenario, such as a music auditorium.

In living room entertainment, two-speaker system playback is both popular and cost-effective. A two-speaker system typically includes a left speaker (Spl) and a right speaker (Spr) along with corresponding amplifiers. In order to reproduce media recorded in the 5.1 channel format using a two-speaker system, the five channel signals (Lf, Rf, Center, Lr, and Rr) may be down-mixed into two channels, left down-mix channel (Ldm) and right down-mix channel (Rdm), then fed to the left and right speakers, Spl and Spr, accordingly. One example of down-mixing is shown in equations 1 and 2 below.

$$Ldm=0.5*(Lf+0.7*\text{Center})+Lr. \quad \text{(eq. 1)}$$

$$Rdm=0.5*(Rf+0.7*\text{Center})+Rr. \quad \text{(eq. 2)}$$

In this example, while facing the Spl and Spr speakers, listeners may sense only limited front space, i.e., the audio sound positioned in front of them, and may not sense the rear space that usually surrounds the listeners from behind. In addition, in this example, the front space is perceived as neither smooth nor continuous. Consequently, such poor 3D performance illustrates the desirability of a 3D sound processing technique that restores or improves the corresponding spaces in the multi-channel sounds, thereby providing 3D effects even though only two speakers are physically present.

There are other sound processing methods available that receive multi-channel audio media and perform signal processing in an attempt to recreate the multi-channel audio media using a two-channel audio system. These sound processing methods rely on modeling 3D perception in the human auditory system. One method of 3D sound processing for a two-speaker system is based on an Interaural Time Delay (ITD) effect combined with filters for modeling the hearing behavior of human ear.

In the ITD-based system 10, shown in FIG. 10, each channel branches out into two channels as follows: for left channel input 12, for example, rear left channel, one branch includes a filter F1 16 that simulates the left ear response to the left side sound (same side or near ear response). The output of F1 16 is then sent to adder 28. In another branch, the left channel input 12 passes through an ITD delay unit 18, followed by a filter F2 24 that simulates the right ear response to the left side sound (opposite side or far ear response), then is sent to adder 30. The ITD delay unit 18 (approximately 10 samples) positions the left channel sound toward the right side.

The same process may be applied to the right channel input 14 which also branches out into two channels. Similarly, filter F1 22 simulates the right ear response to the right side sound, the ITD delay unit 20 positions the right channel sound toward left side, and filter F2 26 simulates the left ear response to the right side sound.

Adder 28 adds the output of filter F1 16 to the output of filter F2 26 and sends the output to Left Output 32. Similarly, adder 30 adds the output of filter F1 22 to the output of filter F2 24 and sends the output to Right Output 34. Left Output 32 and Right Output 34 may then be combined with other channels and output by a two-speaker system.

This method, as well as its modeling strategy, is not successful enough in moving the rear sound far behind the listener to create a satisfying rear surround effect.

SUMMARY

The present disclosure relates to a system for 3D sound processing, comprises a first processing section including a first left lattice filter and a first right lattice filter, respectively electrically connected to a second left lattice filter and a second right lattice filter, and including two negative couplers, each electrically connected to the first left and right lattice filters and also electrically connected to the second left and right lattice filters, and a second processing section including a left filter and a right filter, respectively electrically connected to the second left lattice filter and the second right lattice filter.

In another aspect, the lattice filters are second-order lattice filters. In another aspect, the first left and right lattice filters have a low resonance frequency, and the second left and right lattice filters have a high resonance frequency.

The present disclosure further relates to a method for 3D sound processing, comprises filtering a left input using a first lattice filter, filtering the output of the first lattice filter using a second lattice filter, filtering a right input using a third lattice filter, filtering the output of the third lattice filter using a fourth lattice filter, attenuating the output of the first lattice filter and the output of the third lattice filter, combining the output of the first lattice filter and the output of the second lattice filter, subtracting from the combined output of the first lattice filter and the second lattice filter, a quantity of the attenuated output of the third lattice filter combined with the output of the fourth lattice filter, thereby creating a left processed output, combining the output of the third lattice filter and the output of the fourth lattice filter, and subtracting from the combined output of the third lattice filter and the fourth lattice filter, the quantity of the attenuated output of the first lattice filter combined with the output of the second lattice filter, thereby creating a right processed output.

In another aspect, the method further comprises, filtering the left processed output using a fifth filter, filtering the right processed output using a sixth filter, attenuating the left input and the right input, combining the output of the fifth filter and the attenuated right input, thereby creating a left surround output, and combining the output of the sixth filter and the attenuated left input, thereby creating a right surround output.

In another aspect, the method further comprises combining with the left surround output a second left input and an attenuated center input and outputting to a left speaker, and combining with the right surround output a second right input and the attenuated center input and outputting to a right speaker.

BRIEF DESCRIPTION OF THE DRAWINGS

The foregoing features and other aspects of the present disclosure are explained in the following description taken in connection with the accompanying drawings, wherein.

DETAILED DESCRIPTION OF THE PREFERRED EMBODIMENTS

The system and method of the present disclosure receives and processes a multi-channel digital input signal in order to produce what is observed as a fuller, richer sound when output through two or more speakers. The system and method of the present disclosure may include one or more filters in a cascade structure with successive and distributed negative couplings to create spatialization and an inter-aural time delay which improves a three-dimensional audio effect. In one aspect, the filters may include specific types of filters, for example, second-order lattice filters. Lattice filters may be desirable because they are stable, easy to control, and because they may effectively simulate ear tube resonance.

The system and method of the present disclosure may be executed in hardware or software, using, dedicated or programmable processors, as will be understood by one skilled in the art. In one aspect of the system of the present disclosure, the system may be coded in a programming language, for example, the C programming language.

In the human auditory system, sound wave propagates through the ear canal in a manner that may be modeled using an acoustic tube characterized by resonances governed by the shape and length of the tube. Based on this concept, the system and method of the present disclosure uses a filter having two or more resonances located at low and high frequency regions in the frequency response of the filter. In one aspect, each channel signal of the rear left, rear right pair (or front left, front right pair) may be passed through such a filter, and the combined portions of resonance components of the output of the filter for each channel may be negatively coupled to the opposite side channel. Such a filter having multiple resonances plus the negative coupling of resonance components serves to realize spatialization. Negative coupling, also shown in FIG. 2, may be performed in a distributed manner, i.e. a portion of each resonance may be negatively coupled at the filter outputs of the opposite side channel.

In one aspect, a filter having two major resonances may be substituted by two filters, each having one resonance. In another aspect, each filter may have multiple resonances substantially closely located in order to provide bandwidth wider than a filter having a single resonance.

Figure 3:
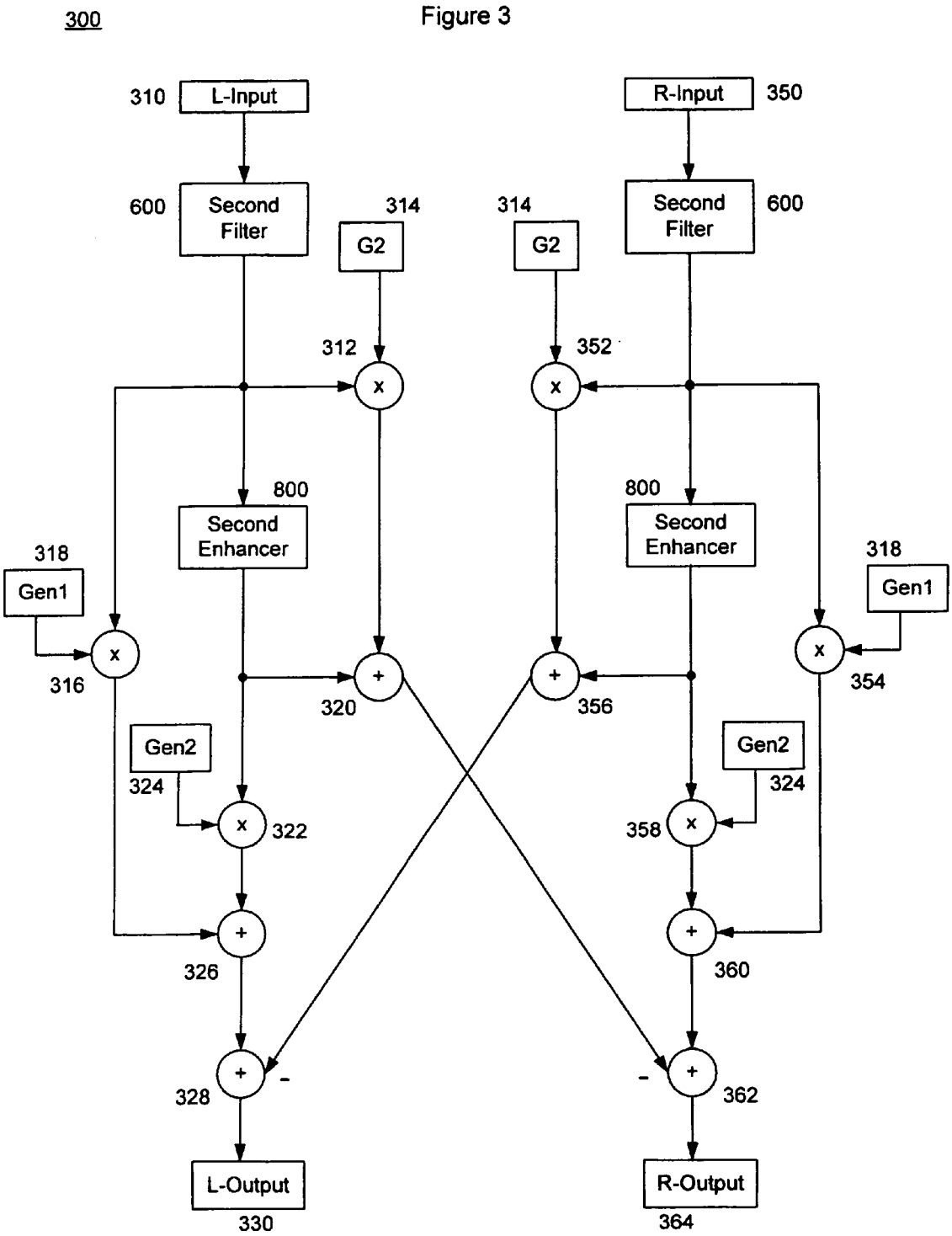
FIG. 3 is a circuit diagram showing a Second Processing Section according to one aspect of the system and method of the present disclosure.

In another aspect, the basic filter (First Filter 500 and First Enhancer 700), may be cascaded with a subordinate filter (Second Filter 600 and Second Enhancer 800) also having at least two resonances that may be less prominent than those in the basic filter. The subordinate filter also may be substituted by two filters, for example, Second Filter 600 and Second Enhancer 800, as shown in FIG. 3, which may be serially connected.

Figure 9:
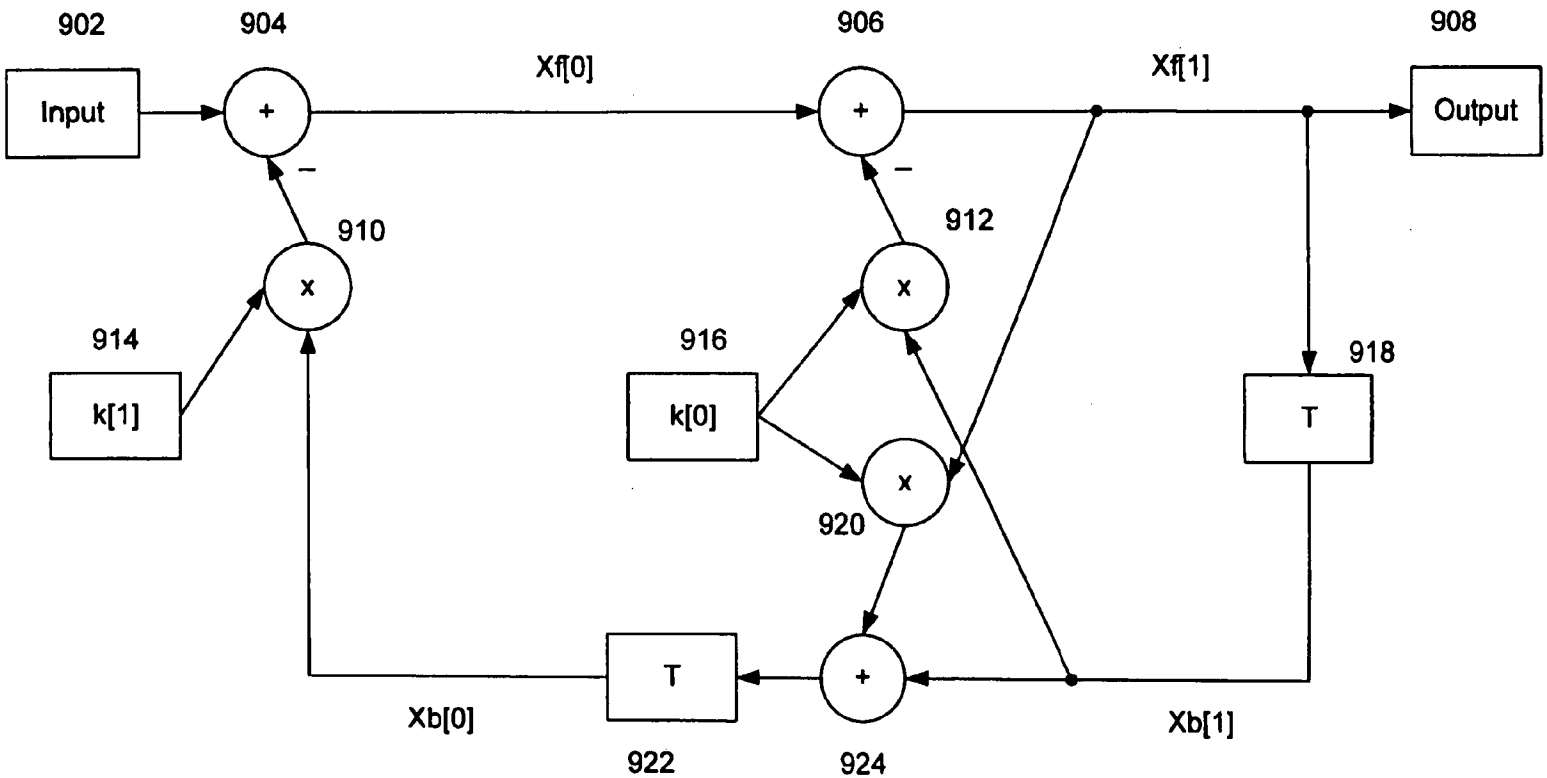
FIG. 9 is a circuit diagram showing an LFilter according to one aspect of the system and method of the present disclosure.
Figure 10:
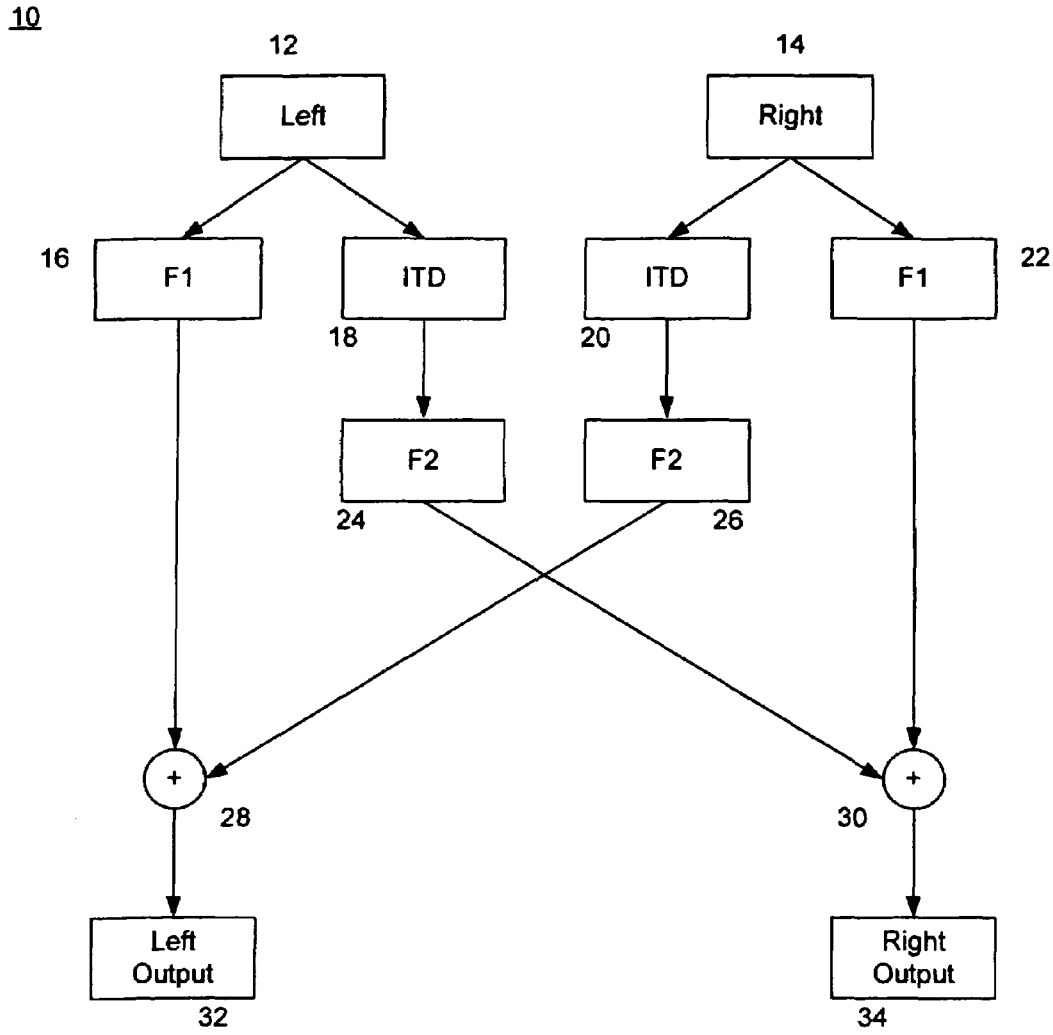
Figure 10 Related Art
FIG. 10 is a circuit diagram showing a system according to the related art.

In another aspect, resonance may be realized by a second order lattice filter, such as LFilter 900, shown in FIG. 9, having forward and backward signal flow that may mimic the reflection and propagation of sound waves in the acoustic tube that models the human ear canals. The second order lattice filter may be represented by two coefficients, k[0] and k[1], that determine the resonance. While the strength of the resonance is proportional to the k[1] value, the resonance frequency (in radians) is related to k[0] and k[1] as follows:

$$\text{resonance frequency}=\text{arc cosine}\ [-k[0]*(1+k[1])/(2*sqrt(k[1]))].$$

The stability of the second order lattice filter may be guaranteed if the absolute values of all the coefficients, here k[0] and k[1], are less than unity, i.e., $|k[0]|<1$ and $|k[1]|<1$. As a result of this stability condition, the resonance may be adjusted and relocated within the limits of criteria and may expand to multiple resonances by adding another second order lattice filter.

The distributed layout of processing performed in the system and method of the present disclosure allows scalability to accommodate implementations having different budgets and complexities. In one aspect, at least the following three configurations may be available: basic filter plus Finite Impulse Response filter (FIR); subordinate filter plus FIR; and basic filter plus subordinate filter plus FIR.

The 3D sound processing system of the present disclosure may receive as input one left-right signal pair, for example, the rear left and rear right pair (Lr, Rr). After processing, rear left surround (Lrs) and right rear surround (Rrs) signals are output to replace Lr and Rr in down-mix equations, eq. 1 and eq. 2. Therefore, through substitution, eq. 1 and eq. 2, above, become eq. 3 and eq. 4, respectively, as follows:

$$Ldms=0.5*(Lf+0.7*\text{Center})+Lrs. \quad \text{(eq. 3)}$$

$$Rdms=0.5*(Rf+0.7*\text{Center})+Rrs. \quad \text{(eq. 4)}$$

When two channel signals (Ldms and Rdms) are output using a two-speaker system, the listener may experience satisfying 3D front, center and rear channel sounds.

In another aspect, similar processing may also be applied using the front left-front right signal pair as inputs, with different parameters and designs. In that aspect, the surrounded outputs, front left surround (Lfs) and front right surround (Rfs), may be created to replace Lf and Rf in the down-mix equations (eqs. 3-4), providing a smoother sound effect for the front space.

In another aspect of the system of the present disclosure, the system may be used with audio systems having more than two speakers, and the processed front left, front right, rear left, rear right, center and low frequency channel signals may be sent to their respective speakers and amplifiers.

Figure 1:
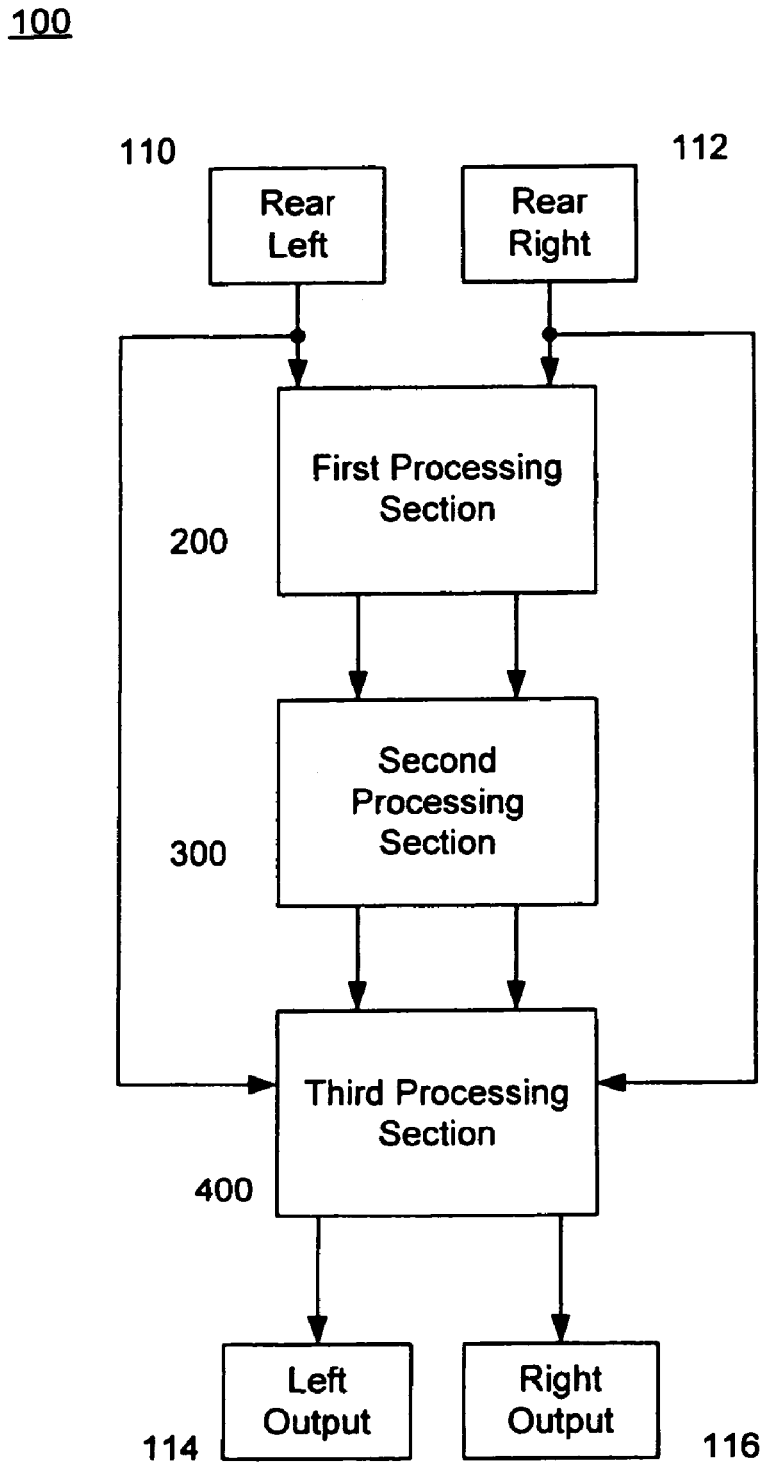
FIG. 1 is a block diagram showing a system according to one aspect of the system and method of the present disclosure.

FIG. 1 is a block diagram showing a system 100 according to one aspect of the system and method of the present disclosure. As shown in FIG. 1, Rear Left channel signal 110 and Rear Right channel signal 112, which may include 16-bit digital data as may be found in the 5.1 channel audio format, may be input into First Processing Section 200, the output of which may be input to Second Processing Section 300, the output of which may then be input to Third Processing Section 400 where rear left channel signal 110 and rear right channel signal 112 may be input. The output of Third Processing Section 400 may then be sent to Left Output 114 and Right Output 116, which may be combined with center and front channels as Lrs and Rrs then reproduced or submitted for further processing.

FIG. 1 shows a cascaded structure and layout which provides scalability. In one aspect, different combinations of filters and enhancers may be included in a system based on factors such as device capability, desired output quality, and cost. For example, in one aspect, the First Processing Section 200 may be omitted and the Rear Left channel signal 110 and Rear Right channel signal 112 may be input into Second Processing Section 300, where the processing continues as described above. In another aspect, the Second Processing Section 300 may be omitted and the output of the First Processing Section 100 may be input into Third Processing Section 400, where the processing continues as described above. In yet another aspect, Third Processing Section 400 may be omitted from the above examples.

Figure 2:
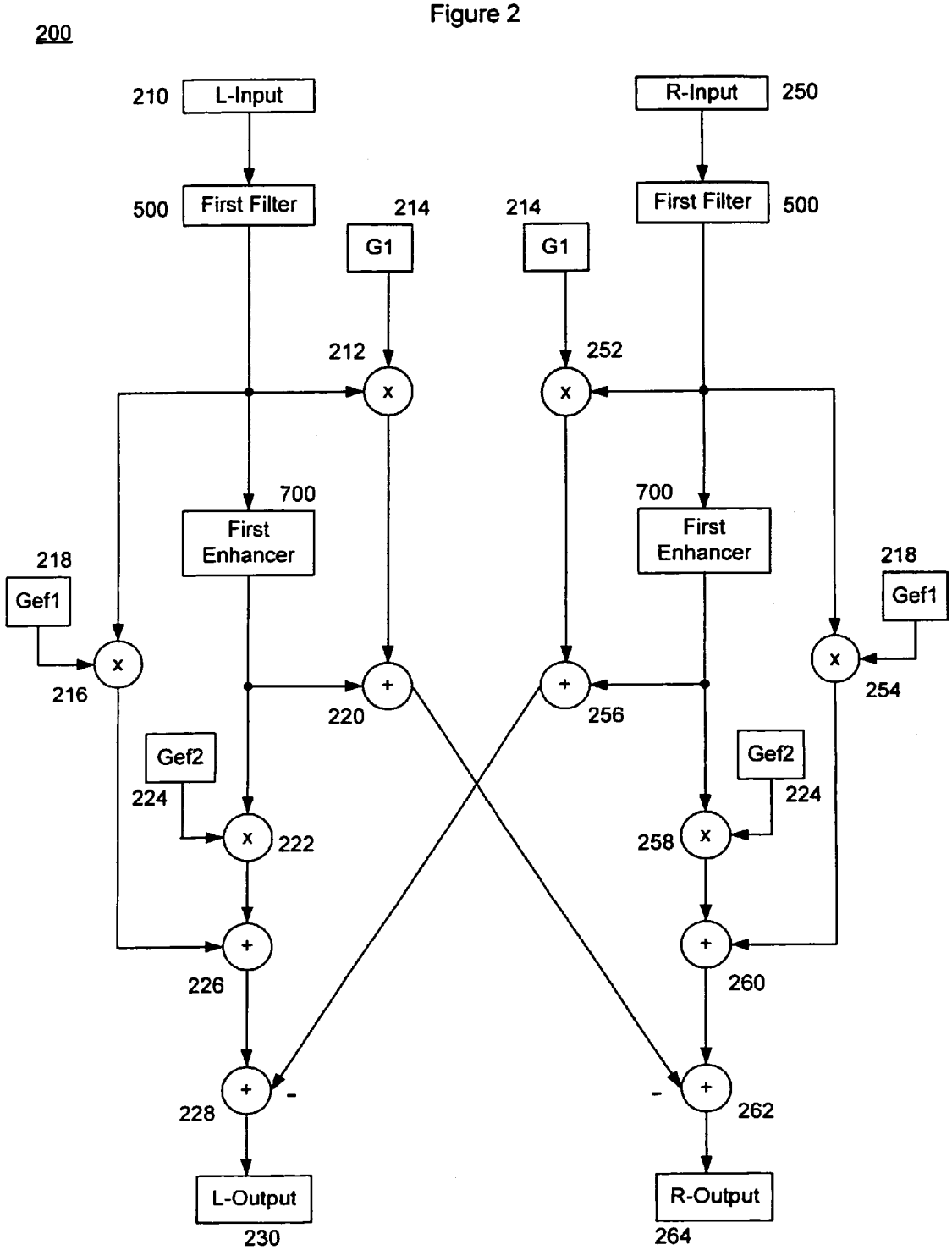
FIG. 2 is a circuit diagram showing a First Processing Section according to one aspect of the system and method of the present disclosure.

FIG. 2 is a circuit diagram showing a First Processing Section 200 according to one aspect of the system and method of the present disclosure.

A Rear Left channel signal 110 may be applied to L-Input 210 and a Rear Right channel signal 112 may be applied to R-Input 250, for generating processed signals at L-Output 230 and R-Output 264, respectively.

As shown in FIG. 2, L-Input 210 is sent to First Filter 500, shown in FIG. 5 and described below, the output of which is sent to multiplier 212 where it is multiplied by G1 214 then sent to adder 220. The output of First Filter 500 is also sent to multiplier 216 where it is multiplied by Gef1 218 then sent to adder 226.

The output of First Filter 500 is also sent to First Enhancer 700, shown in FIG. 7 and described below, the output of which is sent to adder 220 where it is added to the output of multiplier 212 and sent to adder 262, where its negative is used. The output of First Enhancer 700 is also sent to multiplier 222 where it is multiplied by Gef2 224. The outputs of multiplier 216 and multiplier 222 are sent to adder 226, the output of which is sent to adder 228 where it is added to the negative of the output of adder 256. The output of adder 228 is then sent to L-Output 230.

Similarly, the Rear Right channel signal 112 may be applied to R-Input 250 then sent to First Filter 500, the output of which is sent to multiplier 252 where it is multiplied by G1 214 then sent to adder 256. The output of First Filter 500 is also sent to multiplier 254 where it is multiplied by Gef1 218 then sent to adder 260.

The output of First Filter 500 is also sent to First Enhancer 700, the output of which is sent to adder 256 where it is added to the output of multiplier 252 and sent to adder 228 where its negative is used. The output of First Enhancer 700 is also sent to multiplier 258 where it is multiplied by Gef2 224. The outputs of multiplier 254 and multiplier 258 are sent to adder 260, the output of which is sent to adder 262 where it is added to the negative of the output of adder 220. The output of adder 262 is then sent to R-Output 264.

As described above, in one aspect, L-Output 230 and R-Output 264 may be sent to L-Input 310 and R-Input 350, respectively, of Second Processing Section 300, as shown in FIG. 3.

FIG. 3 is a circuit diagram showing a Second Processing Section 300 according to one aspect of the system and method of the present disclosure. As shown in FIG. 3, the structure of Second Processing Section 300 is similar to First Processing Section 200 shown in FIG. 2.

L-Input 310 is sent to Second Filter 600, shown in FIG. 6 and described below, the output of which is sent to multiplier 312 where it is multiplied by G2 314 then sent to adder 320. The output of Second Filter 600 is also sent to multiplier 316 where it is multiplied by Gen1 318 then sent to adder 326.

The output of Second Filter 600 is also sent to Second Enhancer 800, shown in FIG. 8 and described below, the output of which is sent to adder 320 where it is added to the output of multiplier 312 and sent to adder 362, where its negative is used. The output of Second Enhancer 800 is also sent to multiplier 322 where it is multiplied by Gen2 324. The outputs of multiplier 316 and multiplier 322 are sent to adder 326, the output of which is sent to adder 328 where it is added to the negative of the output of adder 356. The output of adder 328 is then sent to L-Output 330.

Similarly, R-Input 350 then sent to Second Filter 600, the output of which is sent to multiplier 352 where it is multiplied by G2 314 then sent to adder 356. The output of Second Filter 600 is also sent to multiplier 354 where it is multiplied by Gen1 318 then sent to adder 360.

The output of Second Filter 600 is also sent to Second Enhancer 800, the output of which is sent to adder 356 where it is added to the output of multiplier 352 and sent to adder 328 where its negative is used. The output of Second Enhancer 800 is also sent to multiplier 358 where it is multiplied by Gen2 324. The outputs of multiplier 354 and multiplier 358 are sent to adder 360, the output of which is sent to adder 362 where it is added to the negative of the output of adder 320. The output of adder 362 is then sent to R-Output 364.

Figure 4:
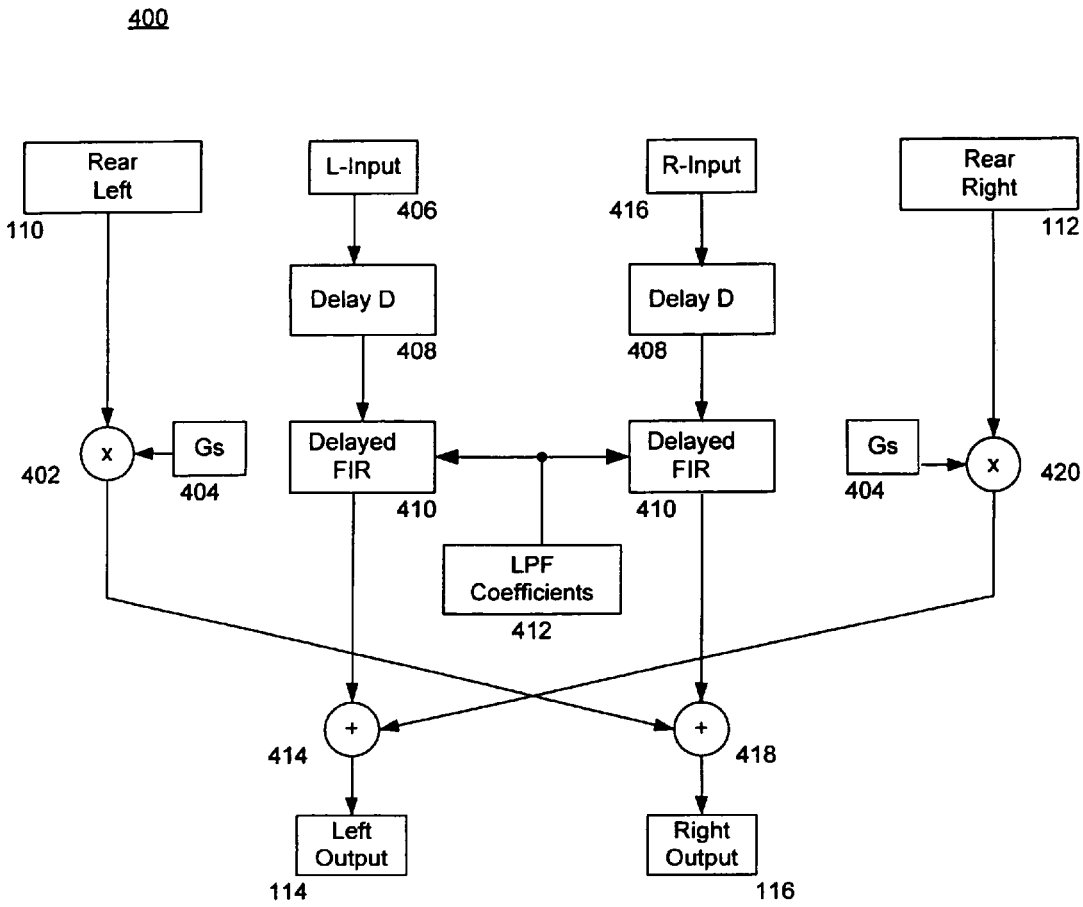
FIG. 4 is a circuit diagram showing a Third Processing Section according to one aspect of the system and method of the present disclosure.

As described above, in one aspect, L-Output 330 and R-Output 364 may be sent to L-Input 406 and R-Input 416, respectively, of Third Processing Section 400, as shown in FIG. 4.

FIG. 4 is a circuit diagram showing a Third Processing Section 400 according to one aspect of the system and method of the present disclosure. In the Third Processing Section 400, R-Input 416 is sent to Delay D 408, which includes a predetermined number D of delay units, then to Delayed FIR 410, which uses LPF Coefficients 412, the output of which is sent to adder 418. Rear Left channel signal 110 is sent to multiplier 402, where it is multiplied by Gs 404, then sent to adder 418, where it is added to the output of Delayed FIR 410 which has operated on R-Input 416. Output of adder 418 is then sent to Right Output 116.

Similarly, L-Input 406 is sent to Delay D 408, then to Delayed FIR 410, which uses LPF Coefficients 412, the output of which is sent to adder 414. Rear Right channel signal 112 is sent to multiplier 420, where it is multiplied by Gs 404, then sent to adder 414, where it is added to the output of Delayed FIR 410 which has operated on L-Input 406. Output of adder 414 is then sent to Left Output 114.

The Delayed FIR 410 may provide additional filtering as well as an inherent distributed ITD effect. Delayed FIR 410 may be an M-tap FIR (finite impulse response) filter having an impulse response of length M, which may be represented by lpfcoeffs[M] array. Delayed FIR 410 may operate as a low pass filter designed to have adequate pass-band width to avoid distortion. In one aspect, for one input sample (in[n]), the output sample (out[n]) of the Delayed FIR 410 after Delay D 408 may be represented by sum of a set of delayed samples multiplied by the coefficients as:

$$\text{out}[n]=lpfcoeffs[0]*\text{in}[n-D]+lpfcoeffs[1]*\text{in}[n-1-D]+lpfcoeffs[2]*\text{in}[n-2-D]+\ldots+lpfcoeffs[M-1]*\text{in}[n-(M-1)-D].$$

In one aspect, in order to reduce complexity, the length of impulse response may be truncated to several samples, for example, M=7.

Delayed FIR 410 causes each channel output to fan out into a set of delayed replica that may be equivalent to multiple interaural delays, further improving 3D performance.

Figure 5:
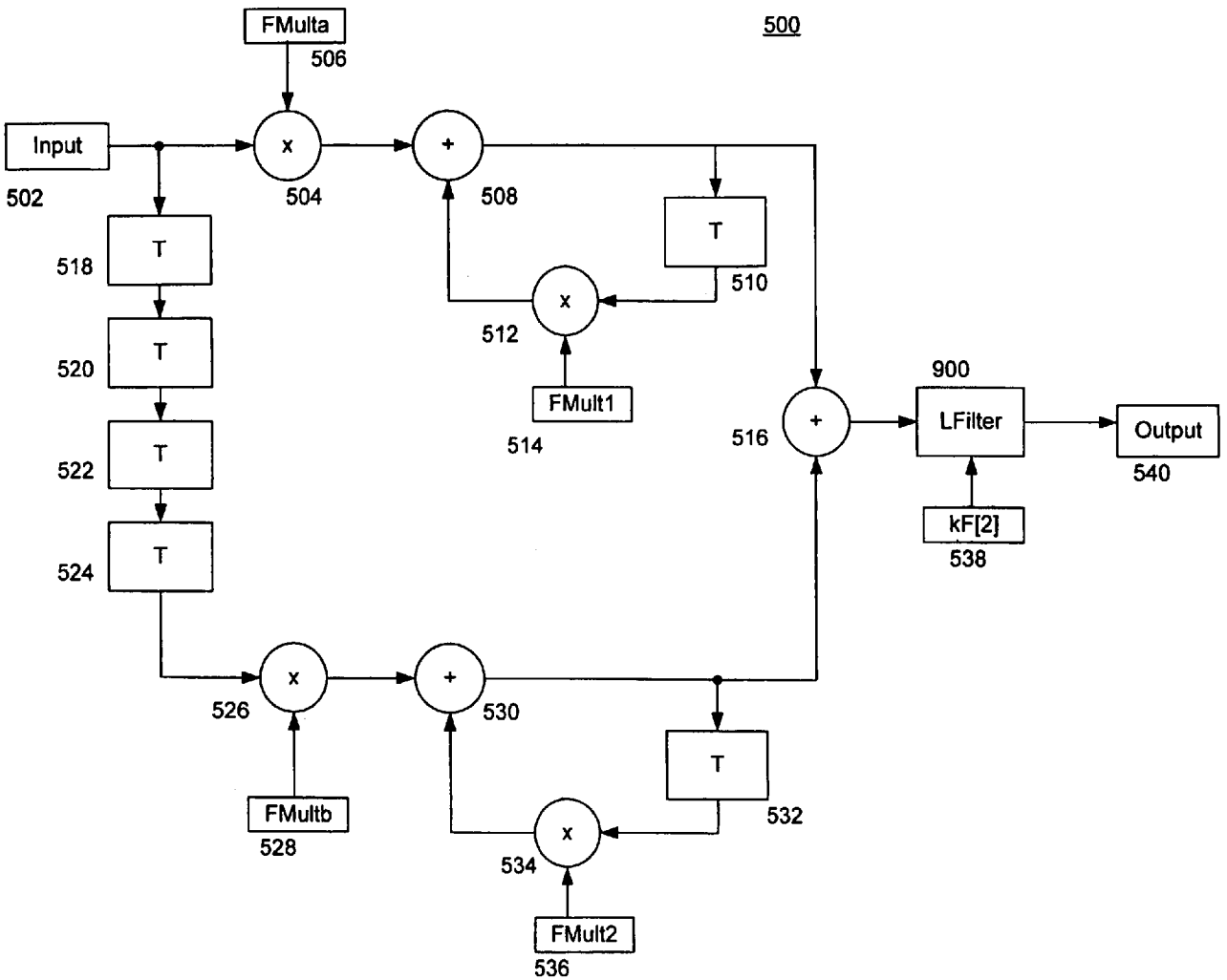
FIG. 5 is a circuit diagram showing a First Filter according to one aspect of the system and method of the present disclosure.

FIG. 5 is a circuit diagram showing a First Filter 500 according to one aspect of the system and method of the present disclosure. In the aspect shown, First Filter 500 includes four one-sample delay elements, two one-tap IIR filters and one second-order lattice filter. Other aspects may include different filter configurations.

In the First Filter 500, Input 502 is sent to multiplier 504 where it is multiplied by FMulta 506. The output of multiplier 504 is sent to adder 508 where it is added to the output of multiplier 512. The output of adder 508 is sent to delay element 510, which holds one sample, then to multiplier 512 where it is multiplied by FMult1 514. The output of adder 508 is also sent to adder 516.

Input 502 is also sent to delay elements 518, 520, 522 and 524, then to multiplier 526 where it is multiplied by FMultb 528. The output of multiplier 526 is sent to adder 530 where it is added to the output of multiplier 534. The output of adder 530 is sent to delay element 532, then to multiplier 534 where it is multiplied by FMult2 536. The output of adder 530 is also sent to adder 516 where it is added to the output of adder 508. The output of adder 516 is sent to LFilter 900 where the coefficient terms are provided by kF[2] 538. The output of LFilter 900 is then sent to Output 540.

Figure 6:
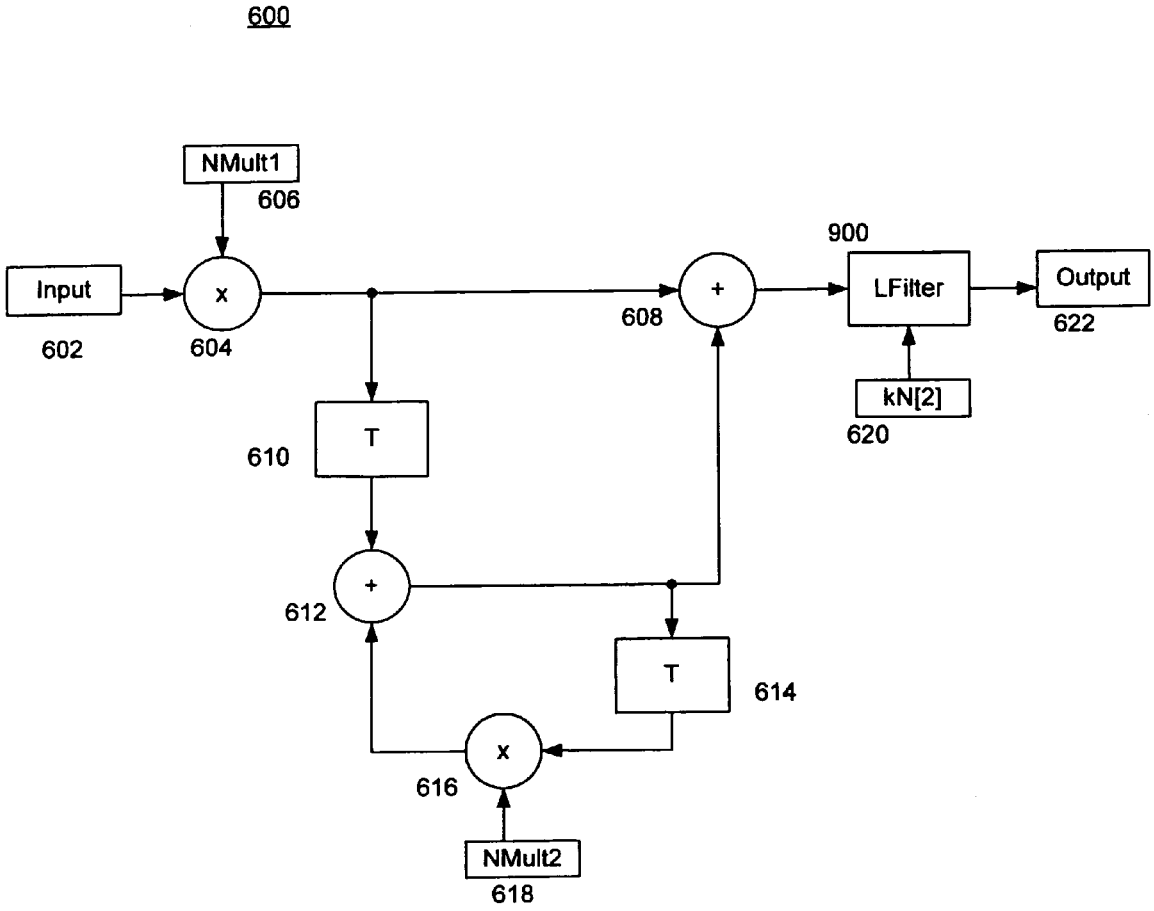
FIG. 6 is a circuit diagram showing a Second Filter according to one aspect of the system and method of the present disclosure.

FIG. 6 is a circuit diagram showing a Second Filter 600 according to one aspect of the system and method of the present disclosure. In the aspect shown, the Second Filter 600 includes one delay element, a one-tap IIR filter and one second-order lattice filter. Other aspects may include different filter configurations.

In the Second Filter 600, Input 602 is sent to multiplier 604 where it is multiplied by NMult1 606 then sent to delay element 610 then adder 612. Output from adder 612 is sent to delay element 614 then multiplier 616 where it is multiplied by NMult2 618. Output from multiplier 616 is sent to adder 612 where it is added to output from delay element 610. Output from adder 612 is also sent to adder 608 where it is added to output from multiplier 604. Output from adder 608 is sent to LFilter 900 where the coefficient terms are provided by kN[2] 620. The output of LFilter 900 is then sent to Output 622.

Figure 7:
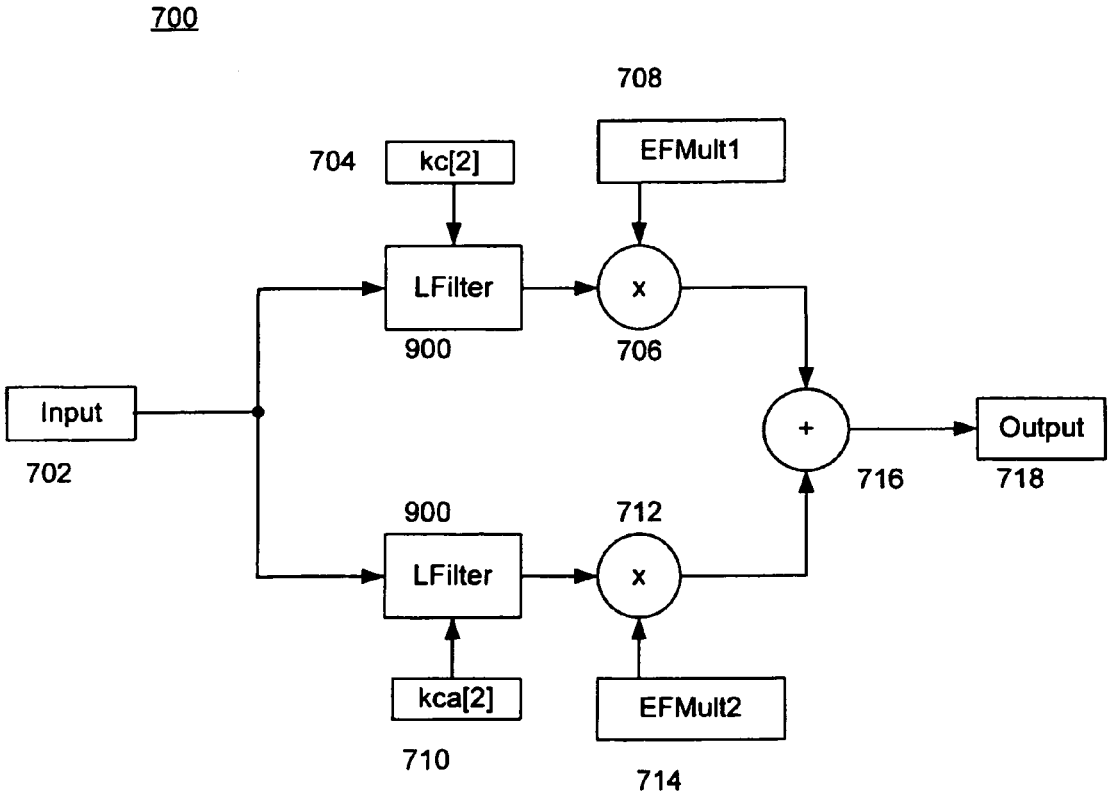
FIG. 7 is a circuit diagram showing a First Enhancer according to one aspect of the system and method of the present disclosure.

FIG. 7 is a circuit diagram showing a First Enhancer 700 according to one aspect of the system and method of the present disclosure. In the aspect shown, the First Enhancer 700 includes two second-order lattice filters arranged in parallel. Other aspects may include different filter configurations.

In the First Enhancer 700, Input 702 is sent to LFilter 900 where coefficient terms are provided by kc[2] 704. The output of LFilter 900 is sent to multiplier 706 where it is multiplied by EFMult1 708, then sent to adder 716. Input 702 is also sent to LFilter 900 where coefficient terms are provided by kca[2] 710. The output of LFilter 900 is sent to multiplier 712 where it is multiplied by EFMult2 714, then sent to adder 716 where it is added to the output of multiplier 706 and sent to Output 718.

Figure 8:
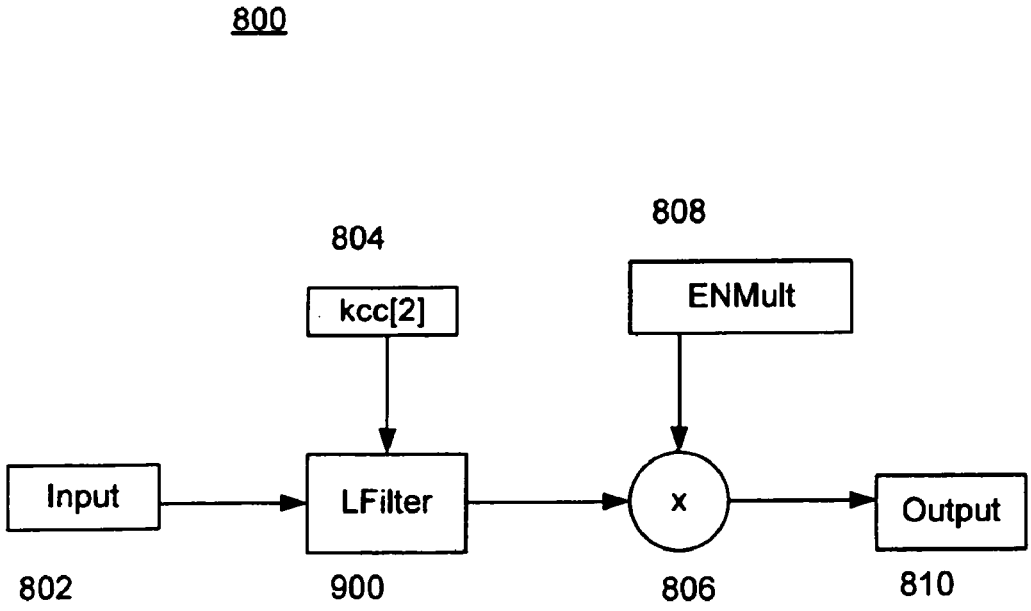
FIG. 8 is a circuit diagram showing a Second Enhancer according to one aspect of the system and method of the present disclosure.

FIG. 8 is a circuit diagram showing a Second Enhancer 800 according to one aspect of the system and method of the present disclosure. In the aspect shown, the Second Enhancer 800 includes one second-order lattice filter. Other aspects may include different filter configurations.

In the Second Enhancer 800, Input 802 is sent to LFilter 900 where coefficient terms are provided by kcc[2] 804. The output of LFilter 900 is sent to multiplier 806 where it is multiplied by ENMult 808 then sent to Output 810.

FIG. 9 is a circuit diagram showing an LFilter 900 according to one aspect of the system and method of the present disclosure. In this aspect, LFilter 900 is a second-order lattice filter. In the LFilter 900, Input 902 is sent to adder 904 where it is added to the negative of the output of multiplier 910. The output of adder 904, referred to here as Xf[0], is sent to adder 906 where it is added the negative of the output of multiplier 912. The output of adder 906, referred to here as Xf[1], is sent to Output 908. The output of adder 906 is also sent to delay element 918, which holds one sample. The output of delay element 918, referred to here as Xb[1], is sent to multiplier 912 where it is multiplied by coefficient k[0] 916. The output of adder 906 is also sent to multiplier 920 where it is multiplied by coefficient k[0] 916 then sent to adder 924 where it is added to the output of delay element 918. The output of adder 924 is sent to delay element 922, which holds one sample. The 110 output of delay element 922, referred to here as Xb[0], is then sent to multiplier 910 where it is multiplied by coefficient k[1] 914.

LFilter 900 may be viewed as having two signal flows. The first, "forward", signal flow proceeds from Input 902, across adder 904 and adder 906 to Output 908, with forward samples referred to as Xf[0] and Xf[1]. The second, "backward", signal flow proceeds from Output 908 across delay element 918, adder 924 and another delay element 922 to multiplier 910 with backward samples referred to as Xb[0] and Xb[1]. For one input sample, the forward samples may be calculated progressively as follows:

$$Xf[0]=\text{Input}-k[1]*Xb[0];$$

$$Xf[1]=Xf[0]-k[0]*Xb[1].$$

In the backward direction, the backward samples Xb[0], Xb[1] are updated as follows:

$$Xb[0]=Xf[1]*k[0]+Xb[1];$$

$$Xb[1]=Xf[1].$$

The updated Xb[0] and Xb[1] values will be used for the calculation of output corresponding to the next input sample.

This lattice structure provides flexibility to change the resonance by adjusting the k[0] and k[1] coefficients referring to the resonant frequency equations as well as the stability conditions described above.

Tables 1-6 below include potential values for coefficients described above and found in the figures, according to one aspect of the system and method of the present disclosure.

TABLE 1

| Coefficients found in FIGS. 2 and 3 | |
|---|---|
| Coefficient | Value |
| G1, G2 | 0.5 |
| Gef1, Gef2 | 1.0 |
| Gen1, Gen2 | 1.0 |

TABLE 2

| Coefficients found in FIG. 4 | |
|---|---|
| Coefficient | Value |
| lpfcoeffs[7] | {0.85, 0.4875, 0.358125, 0.2625937, 0.1921452, 0.1402689, 0.1021296} |
| Gs | 0.15 |
| Delay D | 10 to 20 samples |

TABLE 3

| Coefficients found in FIG. 5 | |
|---|---|
| Coefficient | Value |
| Fmulta | 0.01 |
| Fmultb | 0.0045 |
| FMult1 | 0.85 |
| FMult2 | 0.9 |
| KF[2] | {k[0] −0.7804878, k[1] 0.64} |

TABLE 4

| Coefficients found in FIG. 6 | |
|---|---|
| Coefficient | Value |
| NMult1 | 0.125 |
| NMult2 | 0.25 |
| KN[2] | {k[0] −0.4354136, k[1] 0.7225} |

TABLE 5

| Coefficients found in FIG. 7 | |
|---|---|
| Coefficient | Value |
| EFMult1 | 0.5 |
| EFMult2 | 0.5 |
| kc[2] | {k[0] −0.4411764, k[1] 0.3625} |
| kca[2] | {k[0] −0.3082568, k[1] 0.3625} |

TABLE 6

| Coefficients found in FIG. 8 | |
|---|---|
| Coefficient | Value |
| ENMult | 0.5 |
| kcc[2] | {k[0] −0.7058823, k[1] 0.3625} |

Numerous additional modifications and variations of the present disclosure are possible in view of the above-teachings. It is therefore to be understood that within the scope of the appended claims, the present disclosure may be practiced other than as specifically described herein.

What is claimed is:

1. A method for a 3D sound generation, comprising:

filtering a left input using a first lattice filter;

filtering an output of the first lattice filter using a second lattice filter;

filtering a right input using a third lattice filter;

filtering an output of the third lattice filter using a fourth lattice filter;

attenuating the output of the first lattice filter and the output of the third lattice filter;

combining the output of the first lattice filter and an output of the second lattice filter;

subtracting from the combined output of the first lattice filter and the second lattice filter, a quantity of the attenuated output of the third lattice filter combined with an output of the fourth lattice filter, thereby creating a left processed output;

combining the output of the third lattice filter and the output of the fourth lattice filter;

subtracting from the combined output of the third lattice filter and the fourth lattice filter, a quantity of the attenuated output of the first lattice filter combined with the output of the second lattice filter, thereby creating a right processed output; and generating the 3D sound using a left speaker for sounding the left processed output and a right speaker for sounding the right processed output.

2. The method of claim 1, further comprising:

filtering the left processed output using a fifth filter;

filtering the right processed output using a sixth filter;

attenuating the left input and the right input;

combining an output of the fifth filter and the attenuated right input, thereby creating a left surround output; and combining an output of the sixth filter and the attenuated left input, thereby creating a right surround output.

3. The method of claim 2, further comprising:

combining with the left surround output a second left input and an attenuated center input and outputting to a left speaker; and combining with the right surround output a second right input and the attenuated center input, and outputting to a right speaker.

4. The method of claim 1, wherein for the attenuating, the output of the first lattice filter and the output of the third lattice filter are each multiplied by 0.5.

5. The method of claim 2, wherein for the attenuating the left input and the right input, the left input and the right input are each multiplied by 0.15.

6. The method of claim 2, wherein the fifth filter and the sixth filter are each delayed FIR filters.

7. The method of claim 1, wherein the first, second, third and fourth lattice filters include second-order lattice filters.

8. The method of claim 1, wherein the second lattice filter and the fourth lattice filter each include two second-order lattice filters arranged in parallel.

9. The method of claim 1, wherein the left input is a left rear channel audio signal and the right input is a right rear channel audio signal.

10. The method of claim 3, wherein the second left input is a left front channel audio signal and the second right input is a right front channel audio signal.

11. The method of claim 3, wherein the second left input is an attenuated left front channel audio signal and the second right input is an attenuated right front channel audio signal.

12. The method of claim 1, wherein one of the first lattice filter and the second lattice filter has a low resonance frequency and an other of the first lattice filter and the second lattice filter has a high resonance frequency, and wherein one of the third lattice filter and the fourth lattice filter has a low resonance frequency and an other of the third lattice filter and the fourth lattice filter has a high resonance frequency.

13. A signal processor, comprising:

a. a first left second-order lattice filter electrically connected to a left input signal;

b. a second left second-order lattice filter electrically connected to an output of the first left second-order lattice filter;

c. a first right second-order lattice filter electrically connected to a right input signal;

d. a second right second-order lattice filter electrically connected to an output of the first right second-order lattice filter;

e. a left negative coupler and a right negative coupler, respective inputs of each electrically connected to the outputs of both the first and second left second-order lattice filters and to the outputs of both the first and second right second-order lattice filters;

f. a first left conditioner, an input of the first left conditioner electrically connected to the output the first left second-order lattice filter and the output of the second left second-order lattice filter; and g. a first right conditioner, an input of the first right conditioner electrically connected to the output of the first right second-order lattice filter and the output of the second right second-order lattice filter, wherein an output of the first left conditioner is electrically connected to a negative input of the right negative coupler and an output of the first right conditioner is electrically connected to a negative input of the left negative coupler.

14. The signal processor of claim 13, further comprising:

h. a left delayed FIR filter electrically connected to an output of the left negative coupler;

i. a right delayed FIR filter electrically connected to an output of the right negative coupler;

j a left combiner, inputs of the left combiner electrically connected to the left delayed FIR filter and the right input signal; and k a right combiner, inputs of the right combiner electrically connected to the right delayed FIR filter and the left input signal.

15. A signal processor, comprising:

a. a first left second-order lattice filter electrically connected to a left input signal;

b. a second left second-order lattice filter electrically connected to an output of the first left second-order lattice filter;

c. a first right second-order lattice filter electrically connected to a right input signal;

d. a second right second-order lattice filter electrically connected to an output of the first right second-order lattice filter;

e. a left negative coupler and a right negative coupler, respective inputs of each electrically connected to the outputs of both the first and second left second-order lattice filters and to the outputs of both the first and second right second-order lattice filters;

f. a left delayed FIR filter electrically connected to an output of the left negative coupler;

g. a right delayed FIR filter electrically connected to an output of the right negative coupler;

h. a left combiner, inputs of the left combiner electrically connected to the left delayed FIR filter and the right input signal;

i. a right combiner, inputs of the right combiner electrically connected to the right delayed FIR filter and the left input signal;

j. a left delay electrically coupled between the output of the left negative coupler and an input of the left delayed FIR filter;

k. a right delay electrically coupled between the output of the right negative coupler and an input of the right delayed FIR filter.

16. A signal processor, comprising:

a. a first left second-order lattice filter electrically connected to a left input signal;

b. a second left second-order lattice filter electrically connected to an output of the first left second-order lattice filter;

c. a first right second-order lattice filter electrically connected to a right input signal;

d. a second right second-order lattice filter electrically connected to an output of the first right second-order lattice filter;

e. a left negative coupler and a right negative coupler, respective inputs of each electrically connected to the outputs of both the first and second left second-order lattice filters and to the outputs of both the first and second right second-order lattice filters;

f. a left delayed FIR filter electrically connected to an output of the left negative coupler;

g. a right delayed FIR filter electrically connected to an output of the right negative coupler;

h. a left combiner, inputs of the left combiner electrically connected to the left delayed FIR filter and the right input signal;

i. a right combiner, inputs of the right combiner electrically connected to the right delayed FIR filter and the left input signal;

j. a right attenuator electrically connected between the right input signal and the left combiner; and k. a left attenuator electrically connected between the left input signal and the right combiner.

17. The signal processor of claim 14, wherein each of the left and right delayed FIR filters is a 7-tap filter.

18. The signal processor of claim 13, wherein the first left lattice filter and the first right lattice filter each have a resonance frequency located in a high frequency region and the second left lattice filter and the second right lattice filter each have a resonance frequency located in a low frequency region.

19. The signal processor of claim 13, wherein the first left lattice filter and the first right lattice filter each have a resonance frequency located in a low frequency region and the second left lattice filter and the second right lattice filter each have a resonance frequency located in a high frequency region.

20. A signal processor, comprising:

a. a first left second-order lattice filter electrically connected to a left input signal;

b. a second left second-order lattice filter electrically connected to an output of the first left second-order lattice filter;

c. a first right second-order lattice filter electrically connected to a right input signal;

d. a second right second-order lattice filter electrically connected to an output of the first right second-order lattice filter; and e. a left negative coupler and a right negative coupler, respective inputs of each electrically connected to the outputs of both the first and second left second-order lattice filters and to the outputs of both the first and second right second-order lattice filters;

wherein the second left second-order lattice filter and the second right second-order lattice filter each include two second-order lattice filters arranged in parallel.

21. The signal processor of claim 13, wherein the first left conditioner includes a first left attenuator electrically connected to the output of the first left second-order lattice filter, and a first left combiner, respective inputs of the first left combiner electrically connected to an output of the first left attenuator and the output of the second left second-order lattice filter, and wherein the first right conditioner includes a first right attenuator electrically connected to the output of the first right second-order lattice filter, and a first right combiner, respective inputs of the first right combiner electrically connected to an output of the first right attenuator and the output of the second right second-order lattice filter.

22. A signal processor, comprising:

a. a first left second-order lattice filter electrically connected to a left input signal;

b. a second left second-order lattice filter electrically connected to an output of the first left second-order lattice filter;

c. a first right second-order lattice filter electrically connected to a right input signal;

d. a second right second-order lattice filter electrically connected to an output of the first right second-order lattice filter;

e. a left negative coupler and a right negative coupler, respective inputs of each electrically connected to outputs of both the first and second left second-order lattice filters and to outputs of both the first and second right second-order lattice filters;

f. a first left conditioner and a second left conditioner, each electrically connected to the outputs of both the first and second left second-order lattice filters; and g. a first right conditioner and a second right conditioner, each electrically connected to the outputs of both the first and second right second-order lattice filters, wherein an output of the first left conditioner is electrically connected to a negative input of the right negative coupler and the second right conditioner is electrically connected to a positive input to the right negative coupler, and wherein an output of the second left conditioner is electrically connected to a positive input of the left negative coupler and an output of the first right conditioner is electrically connected to a negative input of the left negative coupler.

23. The signal processor of claim 22, wherein the first left conditioner includes a first left attenuator electrically connected to the output of the first left second-order lattice filter, and a first left combiner, respective inputs of the first left combiner electrically connected to an output of the first left attenuator and the output of the second left second-order lattice filter.

24. The signal processor of claim 22, wherein the second left conditioner includes a second left attenuator electrically connected to the output of the first left second-order lattice filter, a third left attenuator electrically connected to the output of the second left second-order lattice filter, and a second left combiner, respective inputs of the second left combiner electrically connected to an output of the second left attenuator and the third left attenuator.

25. The signal processor of claim 22, wherein the first right conditioner includes a first right attenuator electrically connected to the output of the first right second-order lattice filter, and a first right combiner, respective inputs of the first right combiner electrically connected to an output of the first right attenuator and the output of the second right second-order lattice filter.

26. The signal processor of claim 22, wherein the second right conditioner includes a second right attenuator electrically connected to the output of the first right second-order lattice filter, a third right attenuator electrically connected to the output of the second right second-order lattice filter, and a second right combiner, respective inputs of the second right combiner electrically connected to an output of the second right attenuator and the third right attenuator.

27. The signal processor of claim 13, wherein the left input is a left rear channel audio signal and the right input is a right rear channel audio signal.

28. A method for a sound generation, comprising:

filtering a left input and a right input using second-order lattice filtering to create a first left output and a first right output;

filtering the first left output and the first right output using second-order lattice filtering to create a second left output and a second right output;

combining the first left output and the second left output into a first combined left signal;

combining the first right output and the second right output into a first combined right signal;

subtracting the first combined right signal from the first combined left signal to create a third left output; and generating the sound using a left speaker for sounding the third left output.

29. The method of claim 28, wherein the filtering the left input using a first lattice filter includes filtering using a low resonance frequency, and wherein the filtering the output of the first lattice filter using a second lattice filter includes filtering using a high resonance frequency.

30. The method of claim 28, wherein the left input is a left rear channel audio signal and the right input is a right rear channel audio signal.

31. The method of claim 28 further comprising:

combining the first left output and the second left output into a second combined left signal;

combining the first right output and the second right output into a second combined right signal; and subtracting the second combined left signal from the second combined right signal to create a third right output.

* * * * *